US012390086B2

(12) United States Patent
Bourque

(10) Patent No.: US 12,390,086 B2
(45) Date of Patent: Aug. 19, 2025

(54) HAND-HELD CLEANING TOOL FOR FRONT-LOADING WASHING MACHINES

(71) Applicant: Amber Bourque, Maurice, LA (US)

(72) Inventor: Amber Bourque, Maurice, LA (US)

( * ) Notice: Subject to any disclaimer, the term of this patent is extended or adjusted under 35 U.S.C. 154(b) by 871 days.

(21) Appl. No.: 17/404,888

(22) Filed: Aug. 17, 2021

(65) Prior Publication Data

US 2022/0053921 A1 Feb. 24, 2022

Related U.S. Application Data

(60) Provisional application No. 63/067,253, filed on Aug. 18, 2020.

(51) Int. Cl.

| | |
|---|---|
| ***A47L 25/00*** | (2006.01) |
| ***A46B 5/02*** | (2006.01) |
| ***A46B 15/00*** | (2006.01) |
| ***D06F 39/06*** | (2006.01) |

(52) U.S. Cl.

CPC ..... *A47L 25/00* (2013.01); *A46B 5/026* (2013.01); *A46B 15/0081* (2013.01); *D06F 39/06* (2013.01); *A46B 2200/3073* (2013.01)

(58) Field of Classification Search

CPC ..... A46B 9/026; A46B 9/023; A46B 2200/30; A46B 2200/3073; A46B 2200/3033; A46B 15/0081; A46B 5/026; D06F 39/14; D06F 39/06; A47L 17/06; A47L 13/02; A47L 25/00; A47L 1/06

USPC ..... 15/143.1, 236.07, 111; D4/138; D32/46, D32/51; 30/169

See application file for complete search history.

(56) References Cited

U.S. PATENT DOCUMENTS

| | | | | |
|---|---|---|---|---|
| 1,980,655 | A * | 11/1934 | Balistreri | A47L 13/24 473/294 |
| 2,194,336 | A * | 3/1940 | Tullio | A01B 1/16 30/317 |
| 2,827,697 | A | 3/1958 | Woodel | |
| 2,920,333 | A | 1/1960 | Montague et al. | |
| 4,826,340 | A | 5/1989 | Rothweiler et al. | |
| 5,336,330 | A | 8/1994 | Shumway et al. | |
| 5,454,659 | A | 10/1995 | Vosbikian et al. | |
| 6,115,871 | A * | 9/2000 | Royer | A46B 9/04 15/207.2 |
| 6,298,516 | B1 * | 10/2001 | Beals | A46B 5/026 15/167.1 |
| 6,425,701 | B1 | 7/2002 | Jacobs | |
| 6,546,583 | B1 * | 4/2003 | Rohrig | A46B 17/08 15/167.1 |
| D709,260 | S | 7/2014 | Molinet et al. | |
| 9,277,847 | B2 | 3/2016 | Epting | |
| 9,408,521 | B2 | 8/2016 | Molinet et al. | |
| D770,118 | S | 10/2016 | Neumann | |
| 10,932,642 | B2 | 3/2021 | Bardo | |
| D922,017 | S | 6/2021 | Chaffee et al. | |
| 2009/0038092 | A1 | 2/2009 | Kennedy et al. | |

(Continued)

FOREIGN PATENT DOCUMENTS

DE 202015004205 U1 * 2/2016 ..... A46B 9/026

*Primary Examiner* — Laura C Guidotti
(74) *Attorney, Agent, or Firm* — Greg Mier

(57) ABSTRACT

A hand tool designed to remove lint, dirt, moisture, mold, mildew, hair, and other loose objects from the gasket that is used to seal the access door of a front-loading washing machine and from between the flexible folds in the bellows assembly around the access door of a front-loading washing machine.

13 Claims, 3 Drawing Sheets

(56) References Cited

U.S. PATENT DOCUMENTS

| | | | | |
|---|---|---|---|---|
| 2011/0225755 | A1* | 9/2011 | Carlson | A46B 7/04<br>15/159.1 |
| 2015/0182091 | A1* | 7/2015 | Epting | A01B 1/20<br>15/236.07 |

* cited by examiner

HAND-HELD CLEANING TOOL FOR FRONT-LOADING WASHING MACHINES

CROSS REFERENCE TO RELATED APPLICATIONS

The present application claims priority from provisional patent application No. 63/067,253, filed on Aug. 18, 2020.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC

Not applicable.

FIELD OF THE INVENTION

The subject invention relates generally to hand tools. More particularly, the subject invention relates to hand tools for cleaning the area behind the rubber seal/gasket of a front-loading washing machine.

BACKGROUND OF THE INVENTION

Front-loading clothes washing machines (hereinafter referred to as "front-loaders") have an inner clothes basket and outer tub that are mounted horizontally. Clothes are typically loaded into front-loaders through an access door at the front of the machine. Because the water level in front-loaders can rise above the access door, a gasket is typically used to tightly seal the access door shut during the wash cycle to prevent water dripping onto the floor. The access door is also typically locked shut with an interlocking device during the entire wash cycle, since opening the door while the machine in use could result in water gushing out onto the floor. In most machines, the interlock is usually doubly redundant to prevent either opening with the drum full of water or being opened during the spin cycle.

In addition to the gasket, nearly all front-loaders use a folded flexible bellows assembly around the access door opening to keep clothing contained inside the inner basket during the tumbling wash cycle. If this bellows assembly were not used, then small articles of clothing, such as socks, could slip out of the inner basket near the access door and fall down the narrow slot between the outer tub and the inner basket, and possibly plug the drain and jam the rotation of the inner basket. The bellows assembly around the access door typically has many flexible folds to permit the inner basket to move separately from the access door during the high-speed spin cycle. These flexible folds can collect lint, dirt, hair, and moisture, resulting in mold and mildew growth, and a foul odor. The operating instructions for some front-loaders say that the bellows should be wiped down monthly with a strong bleach solution, while other instructions describe a special "freshening" cycle where the machine is run empty with a strong dosing of bleach.

The present invention is a hand tool specifically designed to remove lint, dirt, moisture, mold, mildew, hair, and other loose objects from the gasket that is used to seal the access door of a front-loading washing machine and from between the flexible folds in the bellows assembly around the access door of a front-loading washing machine.

BRIEF DESCRIPTION OF THE ATTACHED DRAWINGS

The accompanying drawings are provided for the purpose of illustration only and are not intended as a definition of the limits of the present invention.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

The present invention is a hand-held cleaning tool 10 for front-loading washing machines. As shown in FIGS. 1 through 4, the cleaning tool 10 has an elongated handle 11 and an elongated head 12. The handle 11 and head 12 can be constructed together in a single piece or they can be constructed separately and then joined together to form the cleaning tool 10.

The elongated handle 11 is preferably rigid to withstand the forces exerted on it by the user. The material of construction for the handle 11 can be any rigid material, such as metal, wood, hard plastic, and carbon fiber. The handle 11 is preferably ergonomically shaped for a comfortable grasp.

Figure 1:
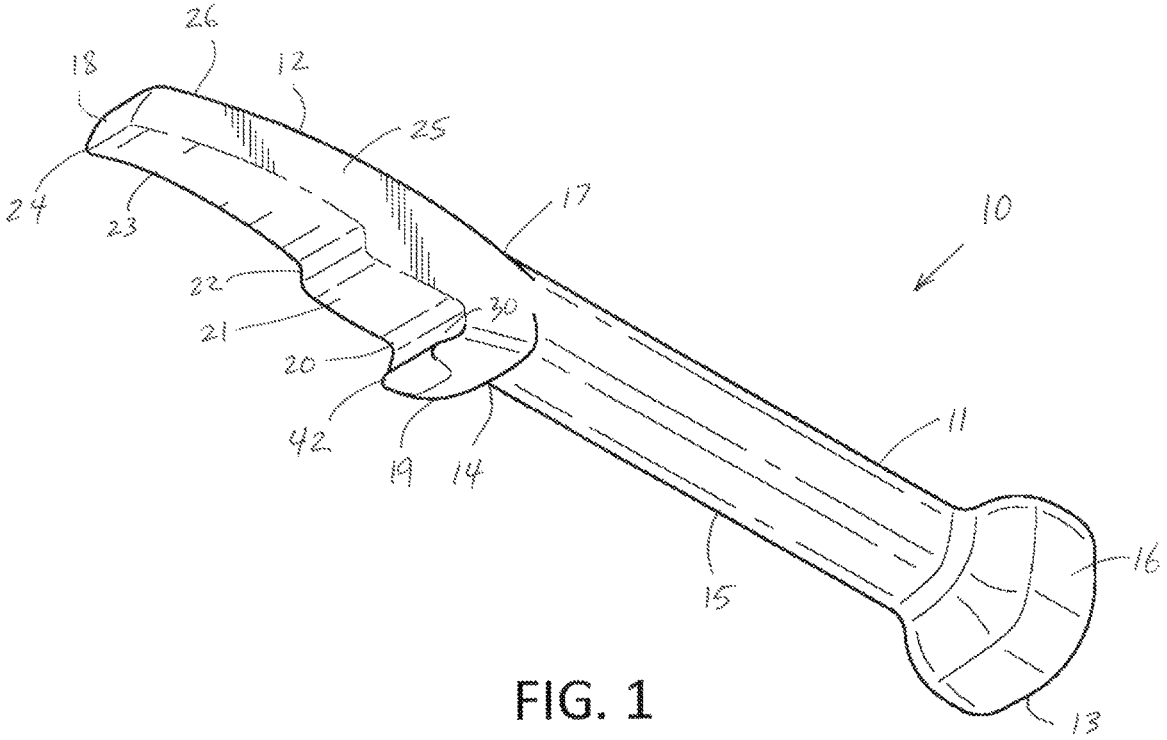
FIG. 1 is an isometric view of one embodiment of the cleaning tool of the present invention.
Figure 2:
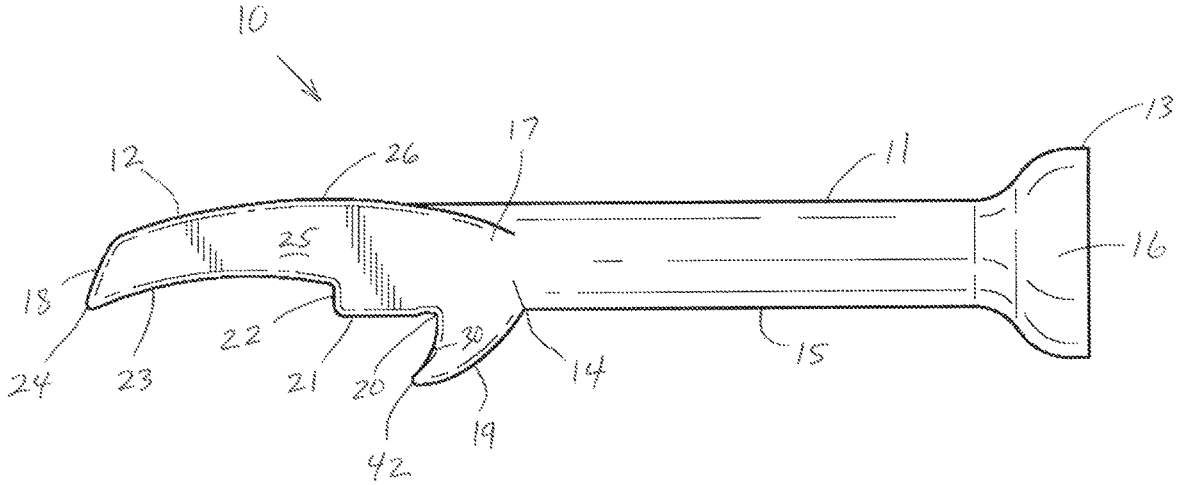
FIG. 2 is a side view of one embodiment of the cleaning tool of the present invention.

As shown in FIGS. 1 through 4, the elongated handle 11 preferably has a first end 13 and a second end 14, with a grip 15 extending between the first end 13 and the second end 14. The grip 15 can be bare or can be coated or wrapped with a gripping material, such as rubber, nitrile, silicone, and neoprene, to make the grip 15 more comfortable and easier to grasp. The length of the grip 15 is preferably four to six inches so that it fits in the palm of a user. The first end 13 of the handle 11 can be equipped with a knob 16, as shown in FIGS. 1 and 2, to make the handle 11 more comfortable and easier to grasp.

The elongated handle 11 merges into the elongated head 12, either as a single piece or as two separate pieces. When handle 11 and head 12 are two separate pieces, then the handle 11 is connected to the head 12 by snapping the two pieces together or by any other means known in the art.

Figure 5:
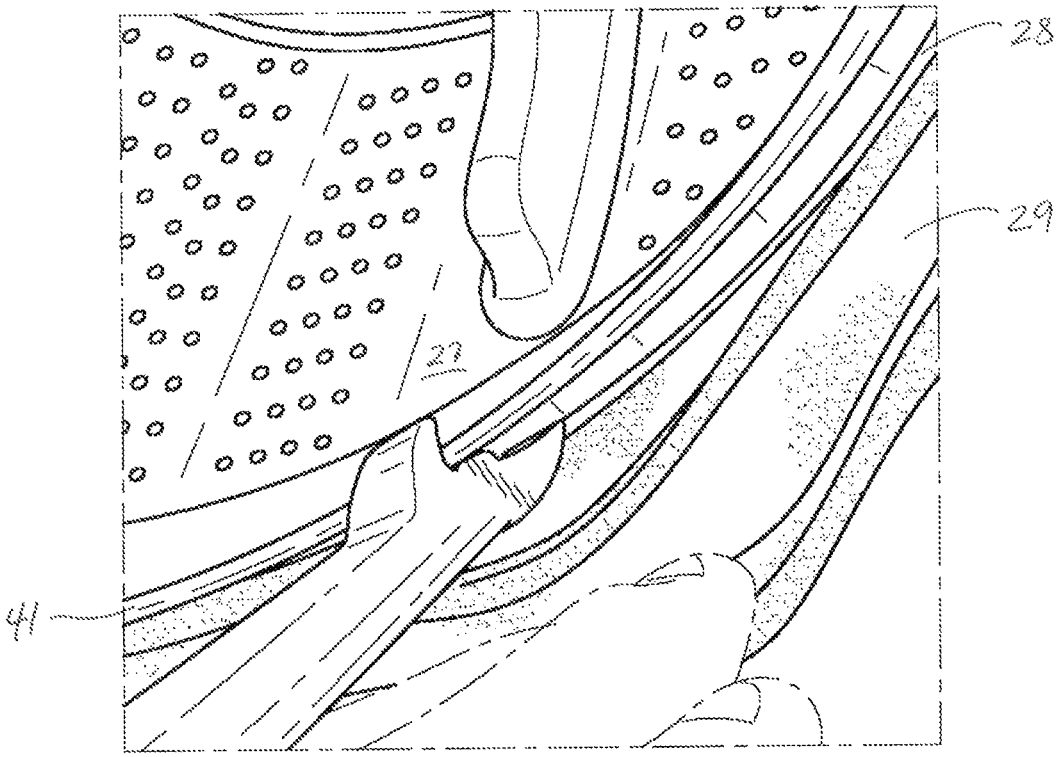
FIG. 5 shows one embodiment of the cleaning tool of the present invention being used to clean a rubber gasket of a front-loading washing machine.
Figure 6:
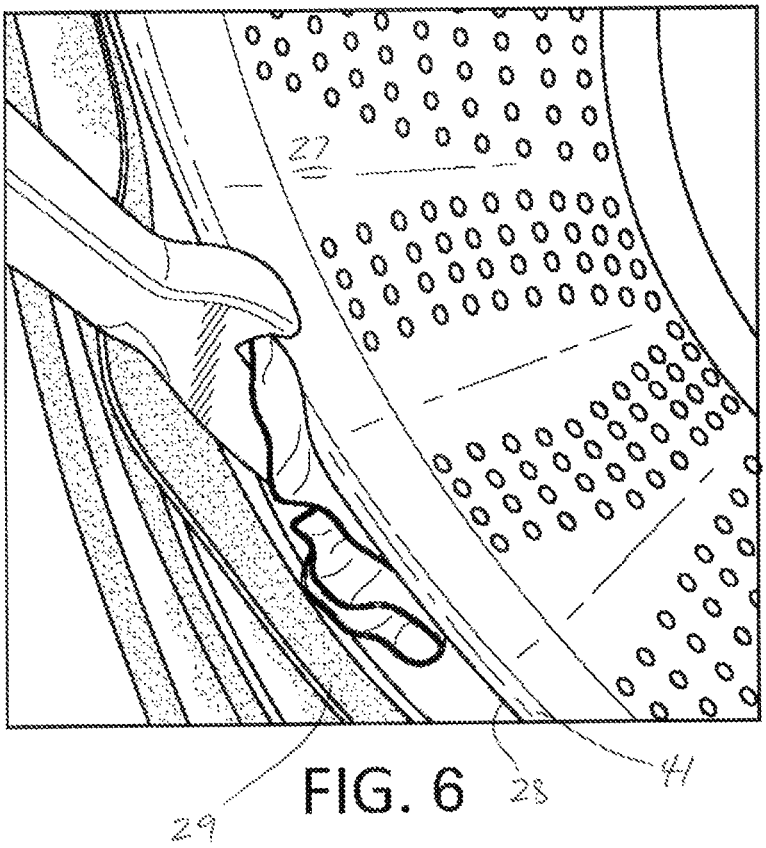
FIG. 6 shows one embodiment of the cleaning tool of the present invention being used with a disposable cloth to clean a rubber gasket of a front-loading washing machine.

In the first embodiment (shown in FIGS. 1 and 2), the elongated head 12 is preferably semi-flexible to allow the head 12 to be inserted between the inner clothes basket 27 and the gasket 28 or the folded flexible bellows assembly 29, as shown in FIGS. 5 and 6. The material of construction for the head 12 is preferably smooth to avoid scratching or damaging the inner clothes basket 27, the gasket 28, or the folded flexible bellows assembly 29.

In the first embodiment, the elongated head 12 has a first end 17 and a second end 18, with a back 26 extending between the first end 17 and the second end 18. The head 12 also has two sides 25 that extend between the first end 17 and the second end 18. The length of the head 12 is preferably three to five inches. The first end 17 of the head 12 adjoins the second end 14 of the handle 11. The second end 18 of the head 12 preferably ends in a tip 24.

As shown in FIGS. 1 and 2, the elongated head 12 preferably has a horn 19 opposite the back 26, where the horn 19 has a leading edge 42 that faces in the general direction of the second end 18 of head 12. The leading edge 42 preferably extends laterally from one side 25 to the other side 25 of head 12. The horn 19 has an inner surface 30 that extends laterally from one side 25 to the other side 25 of head 12 and extends longitudinally from the leading edge 42 to a notch 20. The inner surface 30 of the horn 19 preferably is slightly concave.

The elongated head 12 preferably has a first cleaning surface 21 that extends laterally from one side 25 to the other side 25 of head 12. First cleaning surface 21 extends longitudinally from the notch 20 toward the second end 18 of the head 12 to a shoulder 22. The first cleaning surface 21 of the head 12 preferably is substantially flat, with the flat surface being substantially parallel with the longitudinal axis of the cleaning tool 10.

The shoulder 22 extends laterally from one side 25 to the other side 25 of head 12. Shoulder 22 extends from the first cleaning surface 21 substantially perpendicular to the first cleaning surface 21 and toward the back 26 of the head 12 to a second cleaning surface 23. The shoulder 22 of the head 12 is preferably substantially flat.

The second cleaning surface 23 extends laterally from one side 25 to the other side 25 of head 12 and extends longitudinally from the shoulder 22 toward the second end 18 of the head 12 to the tip 24 of the head 12. The second cleaning surface 23 of the head 12 preferably is slightly concave.

In the second embodiment (shown in FIGS. 3 and 4), the elongated head 12 has a first end 31 and a second end 32, with a back 33 extending between the first end 31 and the second end 32. The head 12 also has two sides 34 that extend between the first end 31 and the second end 32. The length of the head 12 is preferably three to five inches. The first end 31 of the head 12 adjoins the second end 14 of the handle 11.

Figure 3:
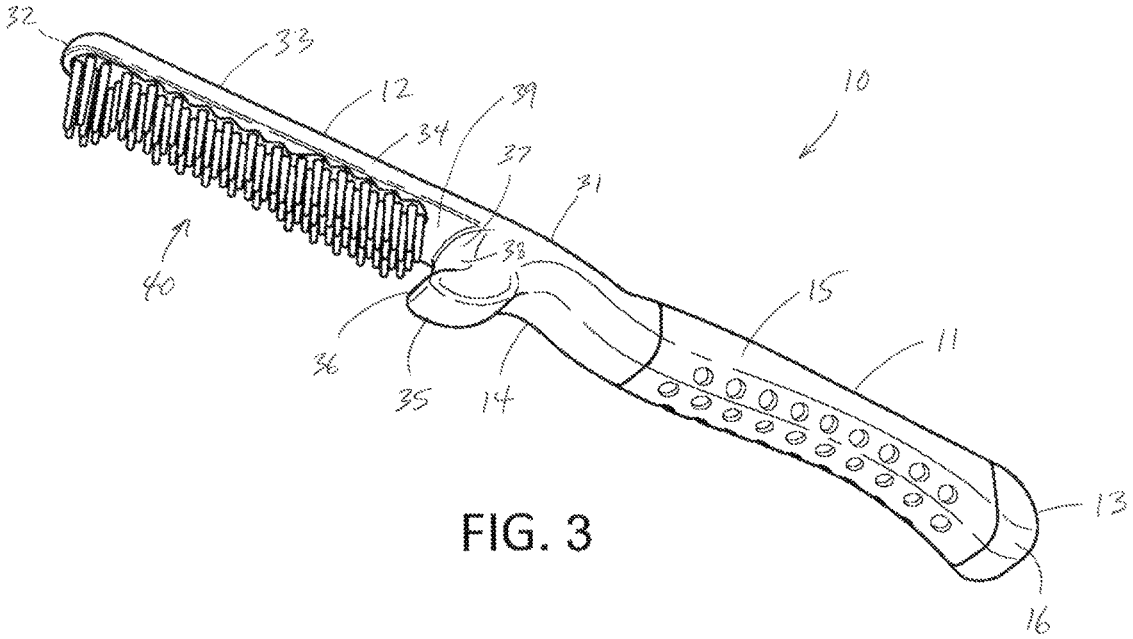
FIG. 3 is an isometric view of another embodiment of the cleaning tool of the present invention.
Figure 4:
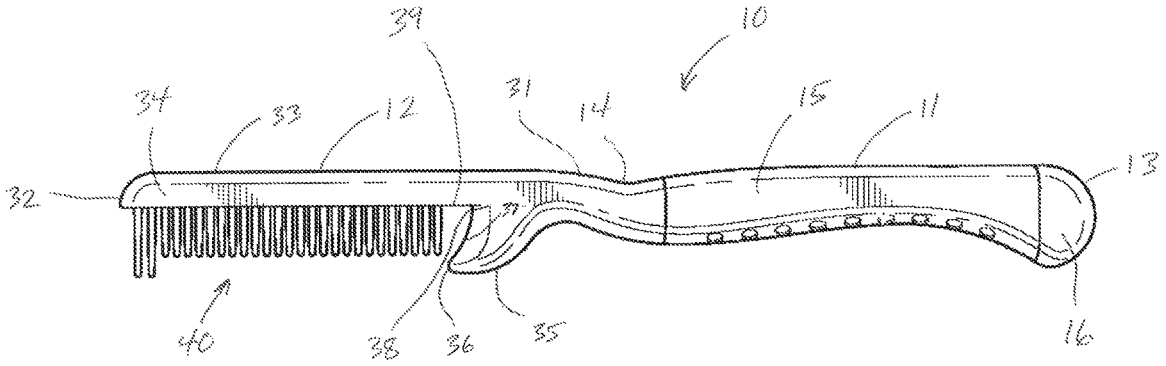
FIG. 4 is a side view of another embodiment of the cleaning tool of the present invention.

As shown in FIGS. 3 and 4, the head 12 of the second embodiment preferably has a horn 35 opposite the back 33, where the horn 35 has a leading edge 36 that faces in the general direction of the second end 32 of the head 12. The leading edge 36 preferably extends laterally from one side 34 to the other side 34 of head 12. The horn 35 has an inner surface 37 that extends laterally from one side 34 to the other side 34 of head 12 and extends longitudinally from the leading edge 36 to a notch 38. The inner surface 37 of the horn 35 preferably is slightly concave.

The elongated head 12 of the second embodiment preferably has a first surface 39 that extends laterally from one side 34 to the other side 34 of head 12. The first surface 39 also extends longitudinally from the notch 38 to the second end 32 of head 12. The first surface 39 of the head 12 is preferably substantially flat, with the flat surface being substantially parallel to the longitudinal axis of the hand tool 10.

As shown in FIGS. 3 and 4, the elongated head 12 has a set of bristles 40 extending from the first surface 39 in a direction that is substantially perpendicular to the first surface 39. The set of bristles 40 are preferably attached to the first surface 39 from a point near the leading edge 36 of the horn 35 to a point near the second end 32 of head 12. The height of the set of bristles 40 can vary, but most of the set of bristles 40 have a height that is slightly less than the height of the horn 35, and some of the set of bristles 40 near the second end 43 of head 12 have a height that is slightly more than the height of the horn 35, as shown in FIG. 4.

In use, the elongated handle 11 of the cleaning tool 11 is grasped by the user, and the elongated head 12 is inserted between the inner clothes basket 27 and the gasket 28, or between the inner clothes basket 27 and the folded flexible bellows assembly 29, with the horn 19 facing the inside of the inner clothes basket 27, as shown in FIGS. 5 and 6. The head 12 is inserted in this manner until the notch 20 lodges against the outer rim 41 of the inner clothes basket 27. With the notch 20 lodged against the outer rim 41, the user can manipulate the cleaning tool 11 side-to-side so that the first cleaning surface 21, the shoulder 22, and the second cleaning surface 23 clean the gasket 28 or the folded flexible bellows assembly 29. In the alternative embodiment, the user can manipulate the cleaning tool 11 side-to-side so that the set of bristles 40 clean the gasket 28 or the folded flexible bellows assembly 29. The user can use the side-to-side action all the way around the outer rim 41 of the inner clothes basket 27 until the entire gasket 28 or the folded flexible bellows assembly 29 is clean.

It is understood that one embodiment of the present invention has been disclosed by way of example and that other modifications and alterations may occur to those skilled in the art without departing from the scope and spirit of the present invention.

What is claimed is:

1. A cleaning tool, comprising:

(a) an elongated handle having a first end, a second end, and a grip extending between said first end and said second end of said elongated handle;

(b) an elongated head having a first end, a second end, two sides, a back, a width measured from one of said two sides to the other of said two sides, and a tip at said second end of said elongated head, where said first end of said elongated head is longitudinally adjoined to said second end of said elongated handle, and where said two sides and said back of said elongated head extend from said first end of said elongated head to said second end of said elongated head;

(c) a horn protruding from said elongated head near said first end of said elongated head opposite of said back of said elongated head, where said horn has a leading edge that faces in the general direction of said second end of said elongated head, where said leading edge has a width that is substantially equal to said width between said two sides of said elongated head, where said horn extends longitudinally from said leading edge to a notch, where said notch is adjacent to said first end of said elongated head; and (d) a first cleaning surface that extends longitudinally from said notch toward said second end of said elongated head to a shoulder, where said shoulder extends from said first cleaning surface substantially perpendicular to said first cleaning surface and toward said back of said elongated head to a second cleaning surface, where said second cleaning surface extends longitudinally from said shoulder toward said second end of said elongated head to said tip of said elongated head, and where said second cleaning surface is concave and extends laterally between said two sides of said elongated head.

2. The cleaning tool of claim 1, where said grip is coated or wrapped with a gripping material, wherein said gripping material is rubber, nitrile, silicone, or neoprene.

3. The cleaning tool of claim 2, where said grip has a length of four to six inches.

4. The cleaning tool of claim 3, further comprising a knob at said first end of said elongated handle.

5. The cleaning tool of claim 4, where said horn has an inner surface that is concave, where said inner surface has a width that is substantially equal to said width between said two sides of said elongated head.

6. The cleaning tool of claim 5, where said first cleaning surface is substantially flat and extends laterally between said two sides of said elongated head.

7. The cleaning tool of claim 6, where said shoulder is substantially flat and extends laterally between said two sides of said elongated head.

8. A cleaning tool, comprising:

(a) an elongated handle having a first end, a second end, and a grip extending between said first end and said second end of said elongated handle;

(b) an elongated head having a first end, a second end, two sides, a back, a width measured from one of said two sides to the other of said two sides, and a tip at said second end of said elongated head, where said first end of said elongated head is longitudinally adjoined to said second end of said elongated handle, and where said two sides and said back of said elongated head extend from said first end of said elongated head to said second end of said elongated head;

(c) a horn protruding a height from said elongated head near said first end of said elongated head opposite of said back of said elongated head, where said horn has a leading edge that faces in the general direction of said second end of said elongated head, where said leading edge has a width that is substantially equal to said width between said two sides of said elongated head, where said horn extends longitudinally from said leading edge to a notch, where said horn has an inner surface that is concave, where said inner surface of said horn has a width that is substantially equal to said width between said two sides of said elongated head, and where said notch is adjacent to said first end of said elongated head;

(d) a first surface that extends longitudinally from said notch to said second end of said elongated head; and (e) a set of bristles extending from said first surface of said elongated head in a direction that is substantially perpendicular to said first surface of said elongated head, where said set of bristles are attached to said first surface of said elongated head from a first point near said leading edge of said horn to a second point near said second end of said elongated head.

9. The cleaning tool of claim 8, where said grip is coated or wrapped with a gripping material, wherein said gripping material is rubber, nitrile, silicone, or neoprene.

10. The cleaning tool of claim 9, where said grip has a length of four to six inches.

11. The cleaning tool of claim 10, further comprising a knob at said first end of said elongated handle.

12. The cleaning tool of claim 11, where a cleaning surface is substantially flat and extends laterally between said two sides of said elongated head.

13. The cleaning tool of claim 12, where most of said set, of bristles have a height that is lower than said height of said horn and where some of set of bristles near said second end of said elongated head have a height that is higher than said height of said horn.

* * * * *